US006169251B1

(12) United States Patent
Grant et al.

(10) Patent No.: US 6,169,251 B1
(45) **Date of Patent: *Jan. 2, 2001**

(54) QUAD CABLE

(75) Inventors: Charles Lloyd Grant, Woodstock Valley, CT (US); Mukesh M. Patel, Westboro, MA (US)

(73) Assignee: The Whitaker Corporation, Wilmington, DE (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

This patent is subject to a terminal disclaimer.

(21) Appl. No.: 08/869,522

(22) Filed: Jun. 6, 1997

Related U.S. Application Data

(60) Provisional application No. 60/042,166, filed on Mar. 31, 1997.

(51) Int. Cl.[7] ..... H01B 7/00

(52) U.S. Cl. ..... 174/113 R; 174/113 C

(58) Field of Search ..... 174/106 R, 113 R, 174/113 C, 131 A, 36

(56) References Cited

U.S. PATENT DOCUMENTS

| | | | | |
|---|---|---|---|---|
| 3,610,814 | * | 10/1971 | Peacock | 174/113 R |
| 3,643,007 | * | 2/1972 | Robert et al. | 174/106 R |
| 3,885,380 | * | 5/1975 | Hacker | 57/162 |
| 4,629,285 | * | 12/1986 | Carter et al. | 350/101 |
| 4,755,629 | | 7/1988 | Beggs, et al. | 174/34 |
| 5,521,333 | * | 5/1996 | Kobayashi et al. | 174/113 R |
| 5,574,250 | | 11/1996 | Hardie et al. | 174/36 |
| 5,777,273 | * | 7/1998 | Woody et al. | 174/113 R |

FOREIGN PATENT DOCUMENTS 1 088 108 3/1955 (FR) .

* cited by examiner

*Primary Examiner*—Kristine Kincaid
*Assistant Examiner*—Chau N. Nguyen

(57) ABSTRACT

A quad cable is constructed with a conducting hollow shield (2) encircling an insulating hollow buffer (3), and insulated conductors (4) encircled by the buffer (3), each of the conductors (4) being spaced from the shield (2) by a distance less than being spaced from a central axis (5) of the shield (2), with the buffer (3) having a lower dielectric constant than that of solid insulation (6) on the each of the conductors (4).

9 Claims, 2 Drawing Sheets

QUAD CABLE

The application claim benefit to Provisional Application 60/042,166 Mar. 31, 1997.

FIELD OF THE INVENTION

The invention relates to a quad cable having at least one quad of signal conductors extending within an encircling insulating buffer, and the buffer being encircled by a conducting shield.

BACKGROUND OF THE INVENTION

According to U.S. Pat. No. 5,574,250, a known, quad cable of high frequency performance is constructed with signal transmitting, insulated signal conductors that are radially spaced from a central axis of the cable. The signal conductors are closer to the central axis of the cable than to an encircling shield. An insulation layer separates the signal conductors from a shield by a lengthy distance, to reduce both signal attenuation, and signal skew, of high frequency signals being transmitted by the known cable. For example, the insulated conductors are spaced by the insulation layer from the shield by at least the same distance, and farther, than they are spaced from the central axis of the cable.

SUMMARY OF THE INVENTION

According to a quad cable of the invention, a cable of at least one quad comprises two pairs of insulated signal conductors, an insulating buffer encircling the conductors, and a conducting shield encircling the buffer. A compact quad cable is achieved. For example, the buffer has a lower dielectric constant than that of insulation on each of the signal conductors. The buffer separates the shield from each of the signal conductors by a distance less than another distance between a central axis of the shield and each of signal conductors. Closer spacing of the shield to the signal conductors provides a compact quad cable.

An embodiment of the invention provides a quad cable with a skew value of 2 picoseconds per foot (2 ps/ft.), and less.

An embodiment of the invention provides a quad cable of desired characteristic impedance.

An embodiment of the invention provides a quad cable of desired characteristic impedance and of a lowered signal skew, and of minimized size, meaning overall diameter of the cable.

An embodiment of the invention provides a technique for lowering signal skew values of a quad cable while maintaining the same size and same characteristic impedance.

An embodiment of the invention provides a quad cable comprising, solid insulation on insulated conductors of the cable with a uniform dielectric constant and a uniform signal skew value, as required without undue control over manufacturing processes for producing an expanded insulation with a uniform dielectric constant.

An embodiment of the invention provides a quad cable with a dielectric buffer between a conducting shield and insulated conductors with uniform signal skew, the conductors being encircled by the buffer, and the buffer being of lower dielectric constant than that of insulation on the conductors to provide the cable with low signal skew at a desired characteristic impedance.

An embodiment of the invention provides a quad cable with solid insulation on insulated conductors of the cable, and an insulating buffer bridging between each of the insulated conductors and a conducting shield, the buffer having a lower dielectric constant that that of the insulation, and the buffer having a thickness that results in the distance between the shield and any conductor being less than the distance between a center axis of the shield and any of the conductors.

An embodiment of the invention provides a quad cable with lower signal skew while maintaining a given characteristic impedance without an increase in size of the cable.

An embodiment of the invention provides a quad cable with solid insulation on the conductors of the cable, and color coding on the insulation having insubstantial effect on dielectric constant, and inconsequential effect on signal skew.

According to an embodiment of the invention, the signal conductors of a quad cable are spaced closer to a shield than they are spaced from a central axis of the cable, and an insulating buffer separating the insulated conductors from the shield has a dielectric constant less than that of insulation on the signal conductors. A quad cable of low skew value is attained.

Marking individual conductors of a cable with color coding is desirable to distinguish among the conductors, for example, to prevent undesired, cross over connections at opposite ends of the cable. In the known cable, the signal conductors are insulated with a foamed or otherwise expanded insulation. Marking the expanded insulation with color coding contributes to inconsistencies in the dielectric constant and the signal skew. For example, marking with ink will adhere to an insulation when it is at an elevated temperature. When the ink is applied to extrudate insulation during expansion of the insulation, the ink produces further inconsistencies in the dielectric constant of the expanded insulation. When the ink is applied after expansion of the insulation, the expanded insulation must be heated, which significantly weakens the self supporting strength of the expanded insulation, to produce an inconsistent dielectric constant. Thus, the application of color coding on expanded insulation presents further inconsistencies in dielectric constant and inconsistent skew values. Marking of the known cable has been restricted to an exterior jacket of the known cable, leaving the individual conductors unmarked and thus indistinct from one another.

According to another embodiment of the invention, the solid insulation on each of the conductors of a quad is suitable for marking, for example, to provide color coding.

Embodiments of the invention will now be described by way of example with reference to the accompanying drawings, according to which:

DETAILED DESCRIPTION

Figure 2:
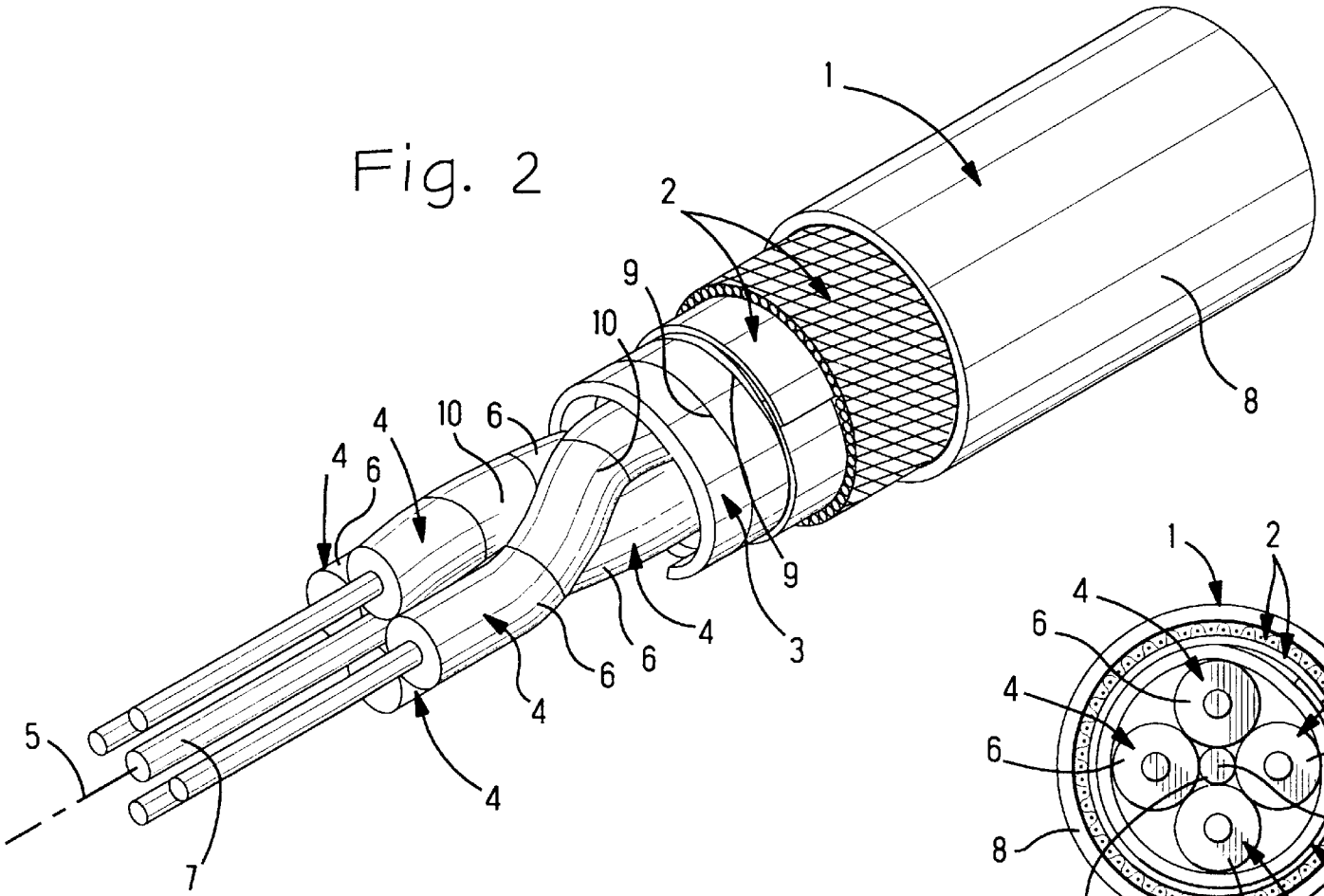
FIG. 2 is an enlarged cross section of the cable as shown in FIG. 1.

With reference to FIGS. 1–4, embodiments of a quad cable 1 will now be described. The cable 1 comprises, a conducting hollow shield 2 that encircles an insulating hollow buffer 3, and two pairs of signal conductors 4 that are encircled by the buffer 3, the buffer 3 separating the conducting shield 2 from the signal conductors 4 by a distance less than another distance of the signal conductors 4 from a central axis 5 of the hollow shield 2. The buffer 3 has a lower dielectric constant than that of insulation 6 on the signal conductors 4, to reduce signal attenuation of the cable 1.

Further with reference to FIGS. 1–4, the central axis 5 of the shield 2 extends lengthwise of the cable 1. The cable 1 comprises at least one quad, wherein each quad comprises two pairs of signal transmitting, insulated signal conductors 4, an encircling buffer 3 and an encircling shield 2. Each pair of signal conductors 4 comprises a quad. The signal conductors 4 of each quad are spaced directly across the central axis 5 from each other. For the purposes of illustration, the cable 1 comprises at least one quad. The cable 1 may comprise more than one quad, not shown, wherein each quad comprises two pairs of signal transmitting, insulated signal conductors 4, an encircling buffer 3 and an optional encircling shield 2.

The signal conductors 4 of each pair engage a cylindrical filler 7 comprising, for example, a cylindrical filament of insulating and flexible material, such as solid polyethylene. The filler 7 maintains a desired minimum spacing of each of the signal conductors 4 from the central axis 5. The filler 7 is engaged by the signal conductors 4 of each pair to resist movement of any one of the signal conductors 4 radially inward.

Optionally, an insulating jacket 8 concentrically encircles each quad within the cable 1. The overall size, for example, an external diameter of the cable 1, is determined, in part, by the total number of quads in the cable 1, and, in part, by each quad being dimensioned by the diameters of the signal conductors 4, the thickness of the buffer 3, the thickness of the shield 6, and the thickness of the jacket 8, for each quad in the cable 1.

When the solid insulation is expanded, the density of the insulation is reduced due to air entrapped in the insulation. The expanded insulation has a lower dielectric constant than unexpanded insulation. However, the process of expansion produces inconsistencies in the dielectric constant of the insulation, which results in inconsistent signal skew. Inconsistent dielectric constant is undesireable as it results in higher signal skew values for the signal conductors 4 of quads.

A quad cable 1 has the following construction without a need for a relatively thick buffer 3. For example, the buffer 3 comprises foamed polypropylene tape helically wrapped over the signal conductors 4 and along the length of the cable 1, with adjacent helices 9 overlapping to provide a concentric hollow shape for the buffer 3. For example, a quad cable 1 is constructed with individual, 24 AWG (American Wire Gauge), conductors 4 comprised of tin plated copper 0.024 inch, (0.61 mm.) diameter.

Figure 1:
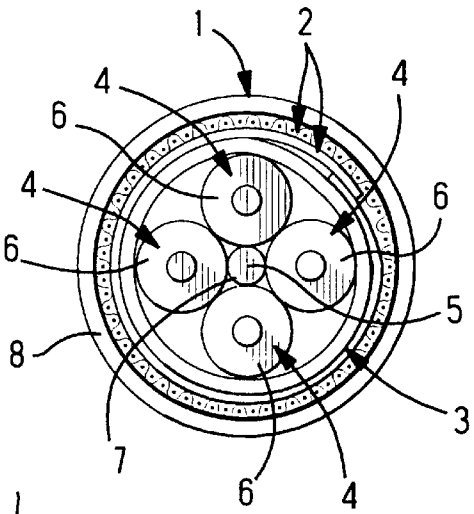
FIG. 1 is a fragmentary perspective view of an electrical cable according to the invention, with parts shown cut away.
Figure 3:
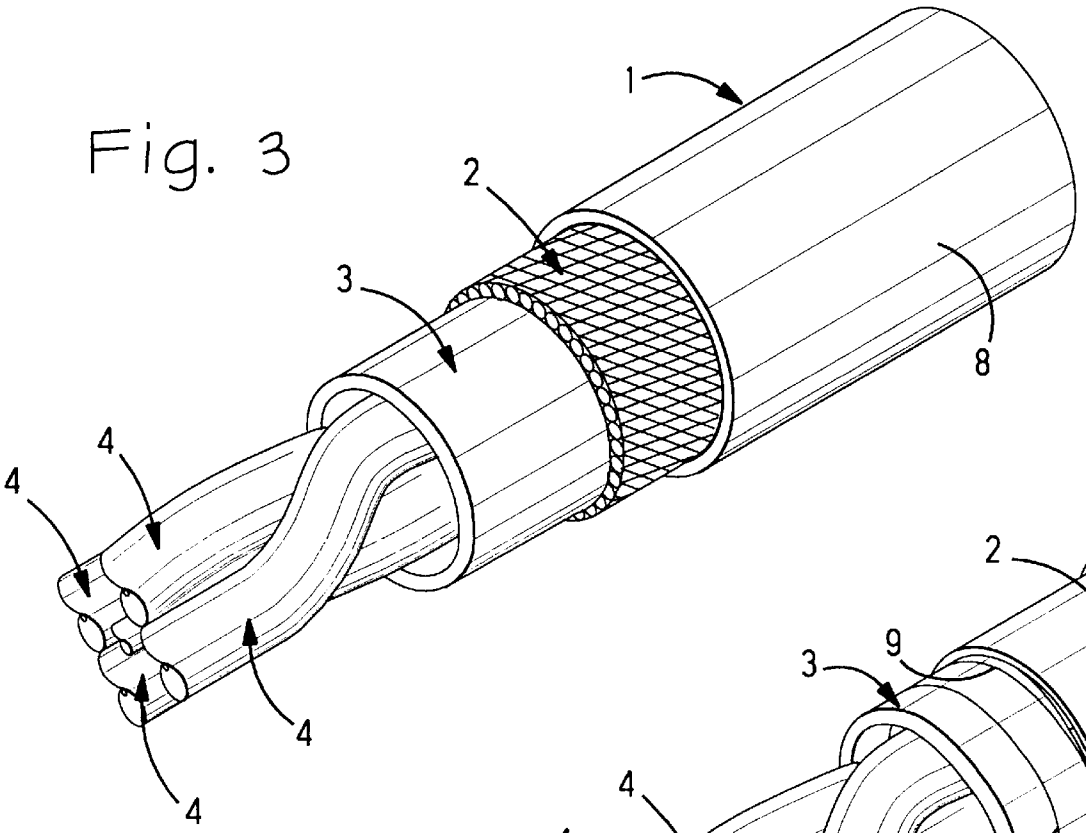
FIG. 3 is a fragmentary perspective view of another embodiment of an electrical cable according to the invention, with parts shown cut away.
Figure 4:
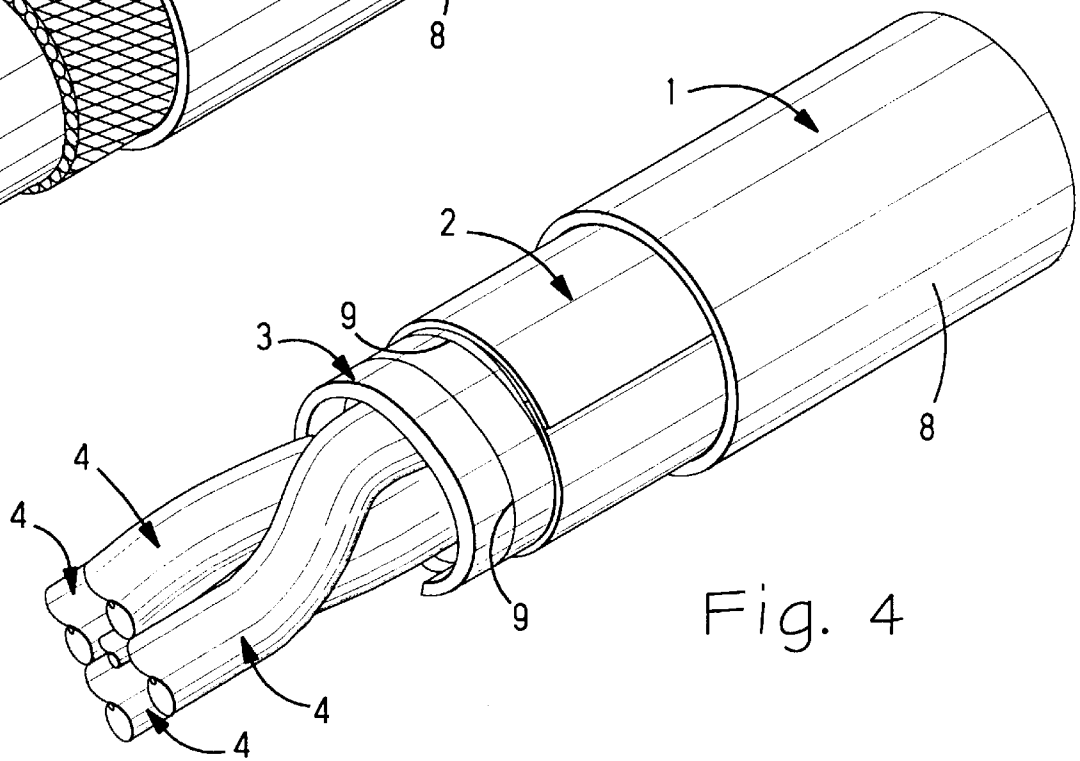
FIG. 4 is a fragmentary perspective view of another embodiment of an electrical cable according to the invention, with parts shown cut away.

With reference to FIG. 1, the shield 2 comprises, for example, a flexible foil layer, of an aluminum coating on one side of an insulating polyester film, facing outward of the central axis 5. The shield 2 is helically wrapped against the buffer 3 and along the length of the cable 1, with adjacent helices overlapping. The shield 2 further comprises a metal conducting braid of tin plated copper strands. The braid encircles and conductively engages the aluminum film layer on the shield 2. With reference to FIG. 3, the shield 2 comprises solely the braid. The buffer 3 is a hollow extrusion. With reference to FIG. 4, the shield 2 comprises solely the aluminum polyester film, described with reference to FIG. 1 above. In each of the embodiments, the buffer 3 is selected with a dielectric constant lower than that of the insulation 6 on each of the signal conductors 4, to enable relatively closer spacing of each of the signal conductors 4 to the shield 2 than to the center axis 5. A compact size of the cable 1 is attained. The jacket 8 covering the shield 2 comprises, for example, a layer of polyvinylchloride.

The insulation 6 on the conductors 4 is suitable for distinctive marking 10, for example, to provide color coded signal conductors 4. Such marking 10 has been known to degrade the dielectric constant of the insulation 6, both by increasing the dielectric constant, and by contributing to an inconsistent dielectric constant.

Color coding is desired on signal conductors 4 within the same cable 1, for example, to avoid undesired cross connection of the signal conductors 4 at opposite ends of the cable 1. Color coding is especially useful to provide a distinctive marking 10 on each of the signal conductors 4, especially when the signal conductors 4 are more difficult to identify when they extend helically along the length of the cable 1, as shown in FIG. 2. The signal conductors 4 of a quad are adapted for color coding by distinctive marking 10.

The signal conductors 4 are insulated by solid insulation 6 that is capable of being marked, for example, with color coding, and the buffer 3 comprises insulation having a lower dielectric constant than the marked insulation 6 on the signal conductors.

An expanded insulation is a dielectric material with cells of air throughout the material, which is produced, for example, by subjecting the material to foaming agents or blowing agents to produce the cells of air. For example, expanded PTFE is a known expanded insulation for electrical conductors. The dielectric constant of the expanded insulation is lowered as a function of its percentage of expansion.

A known quad cable uses expanded insulation on the insulated conductors to lower the dielectric constant. A quad cable of desired characteristic impedance can be constructed by using expanded insulation on the quad conductors, which further requires precise control over the dielectric constant to prevent inconsistent skew along the cable. Inconsistent skew values result from a lack of precise control to attain uniform dielectric constant of the expanded insulation. Non-uniformity of the dielectric constant is due, in part, to cells of air throughout the insulation. The distribution and sizes of the cells will vary, which contributes to inconsistent skew.

According to an embodiment of the invention, a quad cable comprises insulated conductors with solid insulation. Solid insulation is of more uniform dielectric constant than that of expanded insulation. Variation in dielectric constant is inconsequential in solid insulation, so long as the same insulation material of the same thickness is extruded directly on the signal conductors of the quad cable. Solid insulation on the conductors is produced, for example, by direct extrusion of fluent dielectric material, by a known extruder apparatus, onto each of the conductors. The dielectric constant of the solid insulation is substantially the same as that of the dielectric material being selected for extrusion onto the conductors, and is not lowered purposely by introducing air cells throughout the material. The solid insulation on the conductors is of uniform density and uniform dielectric constant, which results in a consistent low skew value in the finished quad cable construction.

After the insulation material has been extruded, the solid insulation material is suitable for marking with ink to provide color coding. Color coding is accomplished without adding pigment to the insulation. Color coding is insignificant in its effect on the dielectric constant of the solid insulation. According to U.S. Pat. No. 5,574,250, color coding is avoided on individual conductors insulated with expanded insulation, or foamed insulation as described in the patent.

A quad cable that is constructed with solid insulation on the quad conductors of the cable provides a consistent signal skew, as described above. However, the solid insulation must be increased in thickness to meet a lower characteristic impedance for the cable. However, the size of the cable becomes too bulky for practical use. Accordingly, prior to the invention, a quad cable with improved signal skew values and a desired characteristic impedance could be attained at the expense of increased cable size.

Various quad cables are described in the following table: 24 AWG 150 Ohm Quad Cable

| Construction | Expanded | Solid | Solid |
|---|---|---|---|
| Outer Diameter, in. | .094 | .118 | .084 |
| Buffer | No | No | Yes |
| Shield | Yes | Yes | Yes |
| Outer Jacket | Yes | Yes | Yes |
| Overall Diameter, in. | .300 | .360 | .300 |
| Typical Skew, ps/ft. | skew >2 | skew <2 | skew <2 |

With reference to the table, a quad cable of desired 150 Ohm characteristic impedance, and with 24 American Wire Gauge (AWG) conductors, has various constructions, some of which are described by three columns of the table. The thickness of the shield and the thickness of the jacket remain the same, or are constants in the various cable constructions. The characteristic impedance of the quad cable is indicative of electrical performance of the quad cable, and must be constant for all changes in cable construction. The same size conductors is desired for all cable constructions to maintain the same attenuation. If the conductor size is reduced the attenuation would increase. This would reduct the maximum length over which the cable could be used. The same overall diameter is desired for all constructions of the quad cable for use in existing connectors and applicator tooling.

A 150 Ohm quad cable, according to the first column of the table, is constructed with expanded insulation on each of the conductors, followed by an encircling shield of conducting film of fixed thickness, followed by an encircling PVC jacket of fixed thickness, and has an overall diameter, or exterior diameter, of 0.300 inches. Such a cable presents a skew value greater than 2 ps/ft. Quad cables can be constructed according to the second and third columns of the table to meet an industry requirement for improved skew values of less than 2 ps/ft., while maintaining the thickness of the shield and the thickness of the jacket as constants for each of the quad cables described by the table.

To improve the skew value to less than 2 ps/ft., solid polyethylene insulation, known as low density polyethylene, is extruded directly onto the conductors, according to the second column of the table. The solid insulation provides a consistent and lower skew value. However, to attain an improved skew value, the outer diameter of the insulation on each of the conductors, has increased to 0.118 in., causing the overall cable diameter, or size, to increase by approximately 20% to 0.360 inches. Such an increase in size of the quad cable is impractical and undesired.

According to an embodiment of the invention, as described in the third column of the table, a quad cable constructed with solid insulation retains a consistent skew value of less than 2 ps/ft, along the length of the cable. A buffer of expanded polypropylene is applied in a continuous ribbon, known as a tape, helically wrapped to encircle the insulated conductors of the quad cable. Helical wraps of the tape overlap one another to build up the thickness of the buffer. The thickness of the buffer is adjusted by overlapping the helical wraps.

The thickness of the buffer is adjusted relative to the thickness of the solid insulation to maintain the desired cable size of 0.300 in. diameter overall. The solid insulation on each of the quad conductors positions each of the conductors away from a center axis of the shield, and relatively closer to the shield, so long as the dielectric constant of the buffer is lower than that of the insulation on the conductors. For a 150 Ohm quad cable of 24 AWG conductors, the outer diameter of the insulation each of the conductors, is adjusted to 0.084 in., while the same material for the buffer is applied in helical wraps to build up to a desired thickness to bridge between the insulated conductors and the inner diameter of the shield of the same size as that of the cable described in the first column of the table.

Although a preferred embodiment of the cable has been described, other embodiments and modifications of the invention are intended to be covered by the spirit and scope of the appended claims.

What is claimed is:

1. A quad cable comprising: a conducting hollow shield encircling an insulating hollow buffer, at least one quad of insulated signal conductors encircled by the buffer, and a filler located within and contacting said at least one quad of insulated signal conductors, said filler maintaining a desired minimum spacing of each of the insulated signal conductors from a central axis of the hollow shield, the buffer having a lower dielectric constant than that of insulation on each of the insulated signal conductors, said filler and buffer locating each of the insulated signal conductors from the conducting shield by a distance that is less than a distance between each insulated signal conductor and the central axis of the hollow shield, said insulated signal conductors engaging one another and said filler without engaging the shield.

2. A quad cable as recited in claim 1 wherein, the signal conductors are insulated by solid insulation, and the buffer comprises insulation with said dielectric constant less than that of the solid insulation.

3. A quad cable as recited in claim 1 wherein, the shield comprises a conducting film.

4. A quad cable as recited in claim 1 wherein, the conducting shield comprises a hollow metal braid.

5. A quad cable as recited in claim 1 wherein, the conducting shield comprises a flexible metal foil engaged by a hollow metal braid.

6. A quad cable as recited in claim 1 wherein, the insulated conductors are marked with color coding.

7. A quad cable comprising: two differential pairs of insulated conductors encircled by an insulating buffer, a conducting shield encircling the buffer, and a filler located within and contacting said differential pairs of insulated conductors, said filler maintaining a desired minimum spacing between said insulated conductors and a central axis of the shield, wherein the filler and buffer locate each of the insulated conductors closer to the shield than to the central axis of the shield, the insulated conductors engaging one another and the filler without engaging the shield, and the buffer has a dielectric constant less than that of insulation on each of the insulated conductors.

8. A quad cable as recited in claim 7 wherein, the insulation is solid insulation.

9. A quad cable as recited in claim 7 wherein, the insulation is extruded directly onto each of the conductors.

* * * * *